US008446087B2

(12) United States Patent
Hao et al.

(10) Patent No.: US 8,446,087 B2
(45) Date of Patent: May 21, 2013

(54) FIELD EMISSION CATHODE STRUCTURE AND FIELD EMISSION DISPLAY USING THE SAME

(75) Inventors: Hai-Yan Hao, Beijing (CN); Jie Tang, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 263 days.

(21) Appl. No.: 13/072,774

(22) Filed: Mar. 28, 2011

(65) Prior Publication Data

US 2012/0161606 A1 Jun. 28, 2012

(30) Foreign Application Priority Data

Dec. 22, 2010 (CN) ..... 2010 1 0600408

(51) Int. Cl.
*H01J 1/62* (2006.01)
*H01J 63/04* (2006.01)

(52) U.S. Cl.
USPC ..... 313/495; 313/496; 313/497; 313/346 R

(58) Field of Classification Search
USPC ..... 313/495–497, 309–310, 336, 346 R, 313/351
See application file for complete search history.

(56) References Cited

U.S. PATENT DOCUMENTS

| | | | | |
|---|---|---|---|---|
| 2002/0043924 | A1 * | 4/2002 | Kato et al. | 313/496 |
| 2007/0096621 | A1 * | 5/2007 | Jeon et al. | 313/495 |
| 2009/0160313 | A1 * | 6/2009 | Yamazaki et al. | 313/495 |
| 2010/0019653 | A1 * | 1/2010 | Jung | 313/496 |

* cited by examiner

*Primary Examiner* — Anh Mai
*Assistant Examiner* — Kevin Quarterman
(74) *Attorney, Agent, or Firm* — Altis Law Group, Inc.

(57) ABSTRACT

A field emission cathode structure includes an insulating substrate, a number of strip cathode electrodes, a number of insulators, a number of strip gate electrodes, a number of electron emission units, and a number of fixing layers. The number of insulators is located among and spaced apart from the number of strip cathode electrodes. The field emission cathode structure further satisfies the following conditions: D1≦D2/10, wherein, D1 is defined as a width of each of the number of insulators, and D2 is defined as a distance between centerlines of each two adjacent field emission units of the number of field emission units.

20 Claims, 7 Drawing Sheets

FIELD EMISSION CATHODE STRUCTURE AND FIELD EMISSION DISPLAY USING THE SAME

RELATED APPLICATIONS

This application claims all benefits accruing under 35 U.S.C. §119 from China Patent Application No. 201010600408.4, filed on Dec. 22, 2010 in the China Intellectual Property Office.

BACKGROUND

1. Technical Field

The present disclosure relates to a field emission cathode structure and a field emission display using the same.

2. Discussion of Related Art

Field emission displays (FEDs) are a novel, rapidly developing flat panel display technology. Compared to conventional displays, such as cathode-ray tube (CRT) and liquid crystal display (LCD), FEDs are superior in providing a wider viewing angle, lower energy consumption, smaller size, and higher quality.

Generally, FEDs can be roughly classified into diode and triode structures. Diode structures have a cathode electrode and an anode electrode, and are suitable for displaying characters, but not suitable for displaying images. The diode structures require high voltage, produce relatively non-uniform electron emissions, and require relatively costly driving circuits. Triode structures were developed from diode structures by adding a gate electrode for controlling electron emission. Triode structures can emit electrons at relatively lower voltages.

A field emission cathode device includes an insulating substrate, a number of cathodes mounted on the insulating substrate, a number of field emission units a dielectric layer having an upper and lower section, disposed on the insulating substrate, and defining a plurality of voids corresponding to the field emission units, and a number of grids disposed between the upper and lower sections, wherein each grid is secured by the upper and lower sections of the dielectric layer.

In use, the field emission units emit electrons under a voltage between the grids and the cathodes. The emitted electrons pass the holes of grids under the attraction forces of the grids. However, the edge of the upper section of the dielectric layer near the field emission unit will be hit by electrons emitting secondary electrons. The movement directions of the secondary electrons are disorderly so that the boundary of the pixel is unclear. Furthermore, after the secondary electrons are emitted, positive charges are accumulated on the upper section of the dielectric layer. The positive charges can change the electric potential around the upper section of the dielectric layer resulting in difficulty controlling electron emissions movement directions. Therefore, field emission display images using the field emission structure have low resolution.

What is needed, therefore, is a field emission cathode structure and a field emission display using the same with superior display resolution.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
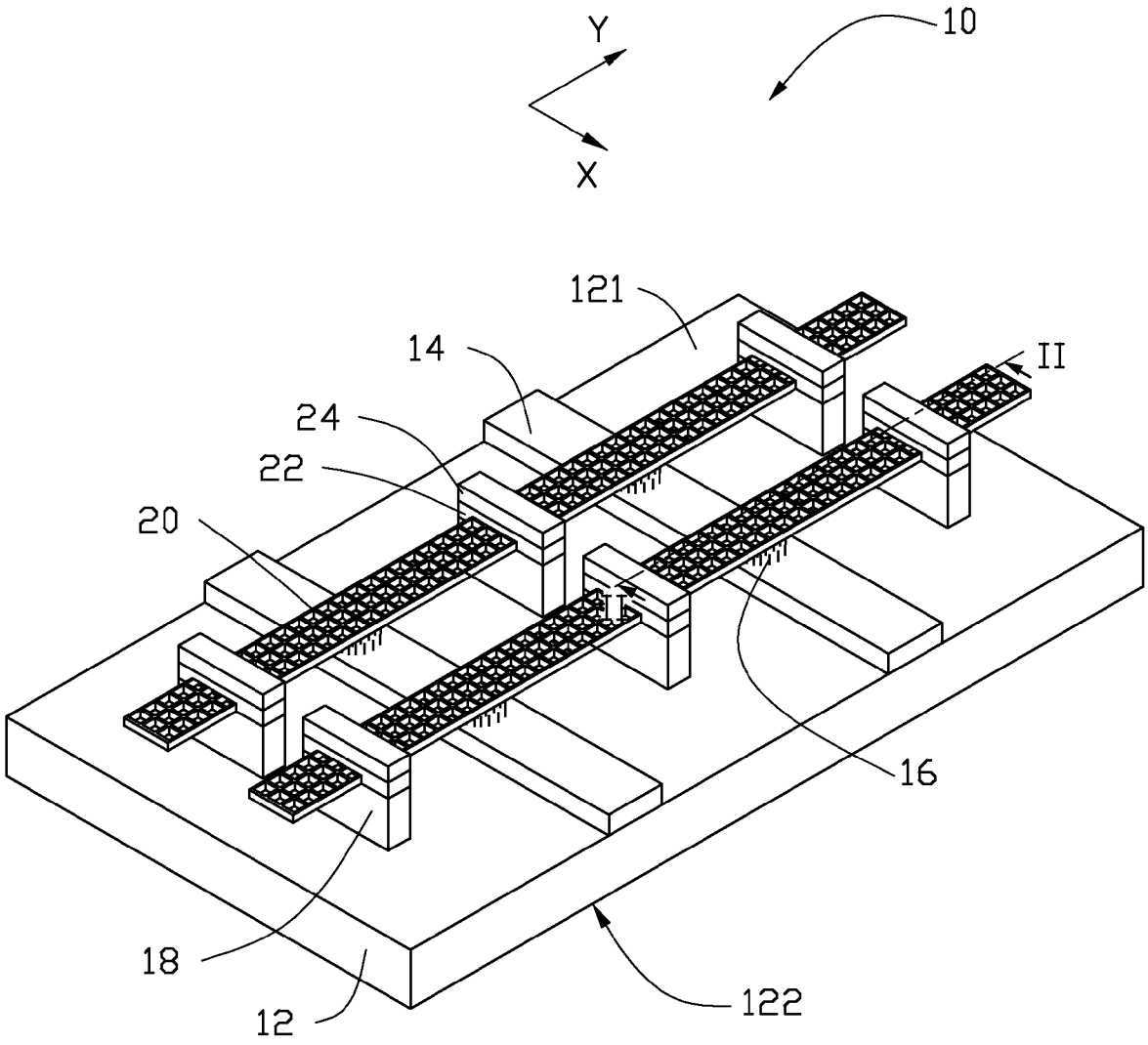
FIG. 1 is a schematic structural view of one embodiment of a field emission cathode structure.
Figure 2:
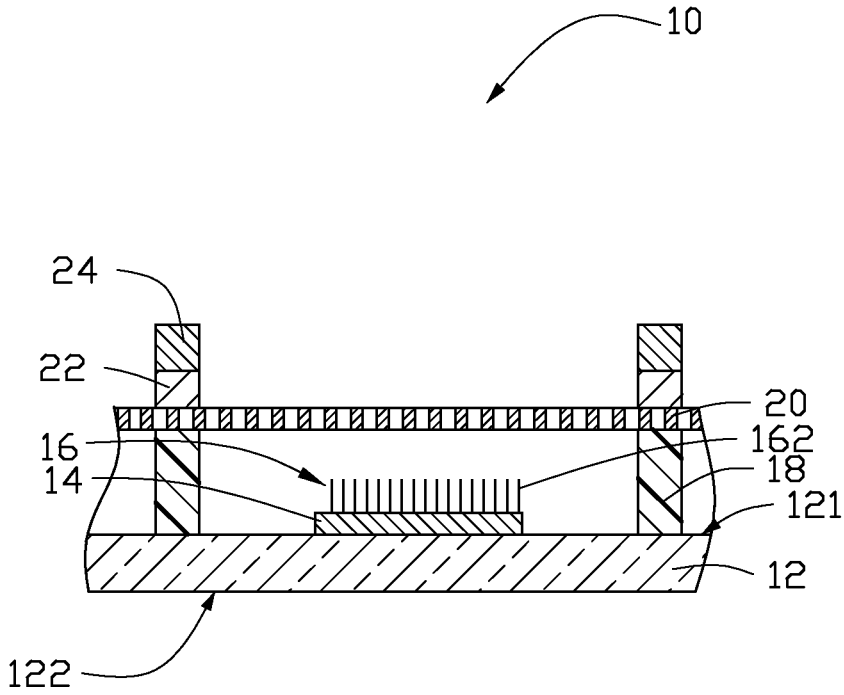
FIG. 2 is a cutaway view along the II-II line of the field emission cathode structure of FIG. 1.

Referring to FIGS. 1 to 2, a field emission cathode structure 10 of one embodiment is provided. The field emission cathode structure 10 includes an insulating substrate 12, a number of cathode electrodes 14, a number of field emission units 16, a number of insulators 18, a number of gate electrodes 20, a number of fixing layers 22, and a number of conductive layers 24.

The cathode electrodes 14 are located on a top surface 121 of the insulating substrate 12. The cathode electrodes 14 are substantially parallel to each other and spaced apart from each other. The insulators 18 are also located on the top surface 121 of the insulating substrate 12. Each cathode electrode 14 is located between and spaced apart from two adjacent insulators 18. The gate electrodes 20 are located on surfaces of the insulators 18 far away from the insulating substrate 12. The gate electrodes 20 are substantially parallel to and spaced apart from each other. The gate electrodes 20 are substantially perpendicular to and spaced apart from the cathode electrodes 14. The gate electrodes 20 cross the cathode electrodes 14. The field emission units 16 are located at every intersection of the gate electrodes 20 and the cathode electrodes 14. The field emission units 16 are electrically connected to the cathode electrodes 14. The fixing layers 22 are located on the gate electrodes 20. The gate electrodes 20 are sandwiched by the fixing layers 22 and the insulators 18. The conductive layers 24 are located on surfaces of the fixing layers 22 away from the insulating substrate 12.

The insulating substrate 12 is used to support the cathode electrodes 14, the field emission units 16, and the insulators 18. The insulating substrate 12 can be made of glass, silicon dioxide, ceramic, or other insulating materials. In one embodiment, the insulating substrate 12 is made of glass. A lengthwise extending direction of the cathode electrodes is defined as the X direction and a lengthwise extending direction of the gate electrodes 20 is defined as the Y direction. The X direction is substantially perpendicular to the Y direction. The X direction and the Y direction are substantially coplanar to the top surface 121 of the insulating substrate 12.

The shape of each of the cathode electrodes 14 can be strip or ribbon shaped. The cathode electrodes 14 can be made of copper, aluminum, gold, silver, indium tin oxide (ITO), or a combination thereof. In one embodiment, the cathode electrodes 14 are made of silver.

The shape of each of the gate electrodes 20 can be strip or ribbon shaped. Each of the gate electrodes 20 defines a number of meshes. The meshes can be uniformly arranged in the gate electrodes 20. The effective diameter of each of the meshes can be in a range from about 3 micrometers to about 1000 micrometers. The gate electrodes 20 can be made of metal. In one embodiment, the gate electrodes 20 are made of stainless steel. In one embodiment, distances between every two adjacent gate electrodes 20 may be equal to distances between every two adjacent cathode electrodes 14. Along a direction substantially perpendicular to the top surface 121, a distance between one gate electrode 20 and a corresponding cathode electrode 14 is larger than 18 micrometers. In one embodiment, the distance between the gate electrode 20 and the cathode electrode 14 is about 20 micrometers.

Each of the field emission units 16 is located on a top surface of the cathode electrode 14 and oriented to one corresponding gate electrode 20. The field emission units 16 are arranged in an array. In one embodiment, the field emission units 16 are located only on the cross positions of the cathode electrodes 14 and the gate electrodes 20. In another embodiment, the field emission units 16 cover the whole top surfaces of the cathode electrodes 14. Each of the field emission units 16 includes a number of field emitters 162. The field emitters 162 have sharp tips and can be metal, silicon, carbon nanotubes, or other materials. The carbon nanotubes can be a carbon nanotube array, a carbon nanotube wire, a carbon nanotube slurry layer or a carbon nanotube film. In one embodiment, each of the field emission units 16 is a carbon nanotube array.

The insulators 18 are configured to support the gate electrodes 20 such that the cathode electrodes 14 are spaced apart from the gate electrodes 20. The insulators 18 are strips. Each of the insulators 18 has a lengthwise direction, which is substantially parallel to the lengthwise direction of the cathode electrodes 14. The insulators 18 are spaced apart from the cathode electrodes 14. Distances between one insulator 18 and two cathode electrodes 14 adjacent to the insulator 18 in the Y direction can be substantially equal. Distances between one insulator 18 and two field emission units 16 adjacent to the insulator 18 in the Y direction can be substantially equal. The material of the insulators 18 can be glass, ceramic, silicon dioxide, or other insulating materials. Each of the insulators 18 can be cubic. The insulator 18 defines a lengthwise direction, a widthwise direction and a height direction. The lengthwise direction is substantially parallel to the X direction. The widthwise direction is substantially parallel to the Y direction. The height direction is substantially perpendicular to the top surface 121 of the insulated substrate 12.

Figure 3:
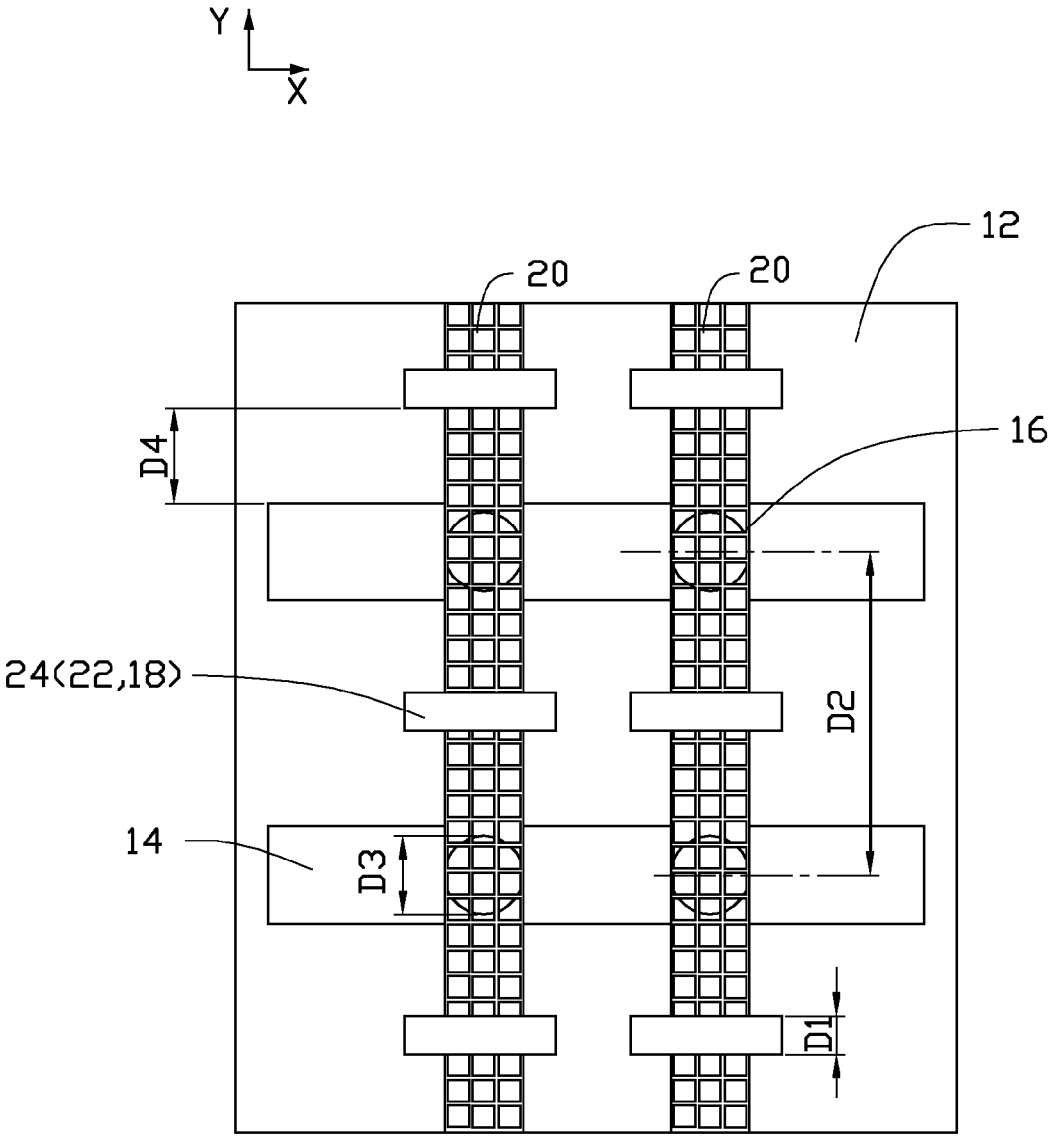
FIG. 3 is a top-view of one embodiment of a field emission cathode structure.

Referring to FIG. 3, to reduce the positive charges accumulated on the fixing layers 22, the field emission cathode structure 10 further satisfies the following conditions:

(1) $D1 \leqq D2/10$, wherein D1 is defined as a width of each of the insulators 18, and D2 is defined as a distance between centerlines of two adjacent field emission units 16.

(2) $0.125 \leqq D3/D2 \leqq 0.48$, wherein D3 is defined as an effective diameter of each of the field emission units 16.

(3) 5 micrometers $\leqq H \leqq$ 100 micrometers, wherein H is defined as a height of each of the insulators 18.

Condition (1) is the relationship between D1 and D2. The fixing layer 22 has substantially the same width and length as that of the insulator 18. If condition (1) is satisfied, the number of the electrons colliding with the fixing layers 22 is reduced after the electrons 20 pass through the gate electrode 20 because the area of the top surface of the fixing layer 22 is relatively small. As a result, the image of the field emission cathode structure 10 will be clear and the resolution of the field emission cathode structure 10 can be improved. D2 can be less than or equal to 5 millimeters. In one embodiment, D2 can be in a range from about 3 millimeters to about 5 millimeters. In another embodiment, D2 is about 1.5 millimeters. D1 can be in a range from about 100 micrometers to about 500 micrometers or in a range from about 200 micrometers to about 400 micrometers. In one embodiment, D1 is about 300 micrometers.

Condition (2) defines the dimension of the field emission units 16. The distance between the insulator 18 and one adjacent field emission unit 16 along the Y direction is defined as D4. If condition (2) is satisfied, the number of electrons colliding with the fixing layers 22 will be reduced after the electrons 20 pass through the gate electrode 20 because the distances between the fixing layers 22 and the field emission units 16 will be small. Therefore, the resolution of the field emission cathode structure 10 can be improved. D4 can be greater than 150 micrometers. In one embodiment, D4 is about 200 micrometers. In another embodiment, D4 is about 250 micrometers. D3 can be less than 2400 micrometers or can be in a range from about 500 micrometers to 1300 micrometers. In one embodiment, D3 is about 400 micrometers. Condition (2) is optional.

Condition (3) defines the height of the insulators 18. H can be in a range from about 10 micrometers to about 15 micrometers. The less the height of the insulators 18, the shorter the distance between the gate electrodes 20 and the cathode electrodes 14 and the lower the voltage applied to the gate electrodes 20. If the voltage applied to the gate electrodes 20 is low, the attraction force that the gate electrodes 20 apply to the electrons will be low, making it difficult for the electrons to collide with the fixing layers 22. Therefore, if condition (3) can be satisfied, the resolution of the field emission cathode structure 10 can be improved.

The fixing layers 22 are configured to fix the gate electrodes 20 between the insulators 18 and the fixing layers 22 to keep the gate electrodes 20 from deforming. The fixing layers 22 cover the surfaces of the gate electrodes 20 corresponding to the insulators 18.

The fixing layers 22 and the insulators 18 are combined together to fix the gate electrodes 20. The material of the fixing layers 22 can be glass, silicon dioxide, ceramic, or other insulating materials. In one embodiment, the material of the fixing layers 22 is the same as the material of the insulators 18 so that the fixing layers 22 and the insulators 18 are combined firmly. In many cases, the fixing layers 22 can be prepared by screen printing. During preparation, the fixing layers 22 are in a liquid-state and infiltrate into the meshes of the gate electrodes 20 to contact with the insulators 18. If the thickness of each of the fixing layers 22 is less than 10 micrometers, the fixing layers 22 will not affect the electrical conductivity between the gate electrodes 20 and the conductive layers 24.

The material of the conductive layers 24 can be metal, alloy, tin indium oxide, antimony tin oxide, conductive silver adhesive, conducting polymer, or carbon nanotube. In many cases, the conductive layers 24 can be prepared by screen printing. During the preparation of the conductive layers 24, the conductive layers 24 are in a liquid-state so that the conductive layers 24 will flow to the insulating substrate 12 along edges of the fixing layers 22, the gate electrodes 20, and the insulators 18. The insulators 18 and the cathode electrodes 14 are spaced apart from each other to avoid the contact between the liquid-state conductive layers 24 and the cathode electrodes 14.

In use, the fixing layers 22 catch the electrons emitted by the emitters 162 and accumulate a number of positive charges. The positive charges accumulated in the fixing layers 22 will increase the difficulty of controlling electron emission directions. The conductive layers 24 are configured to release the positive charges accumulated in the fixing layers 22.

In operation, different voltages are applied to the cathode electrodes 14 and the gate electrodes 20. In many cases, the voltage of the cathode electrodes 14 is about zero or the cathode electrodes 14 are connected to ground. The voltage of the gate electrodes 20 is about ten volts to about several hundred volts. The electrons emitted by the field emitters 162 move towards the gate electrodes 20 under the influence of the applied electric field, and then pass through the meshes of the gate electrodes 20. The cathode electrodes 14 are insulated from each other, as are the gate electrodes 20. Thus, field emission currents at different field emission units 16 can be easily modulated by selectively changing the voltages of the gate electrodes 20 and the cathode electrodes 14.

Figure 4:
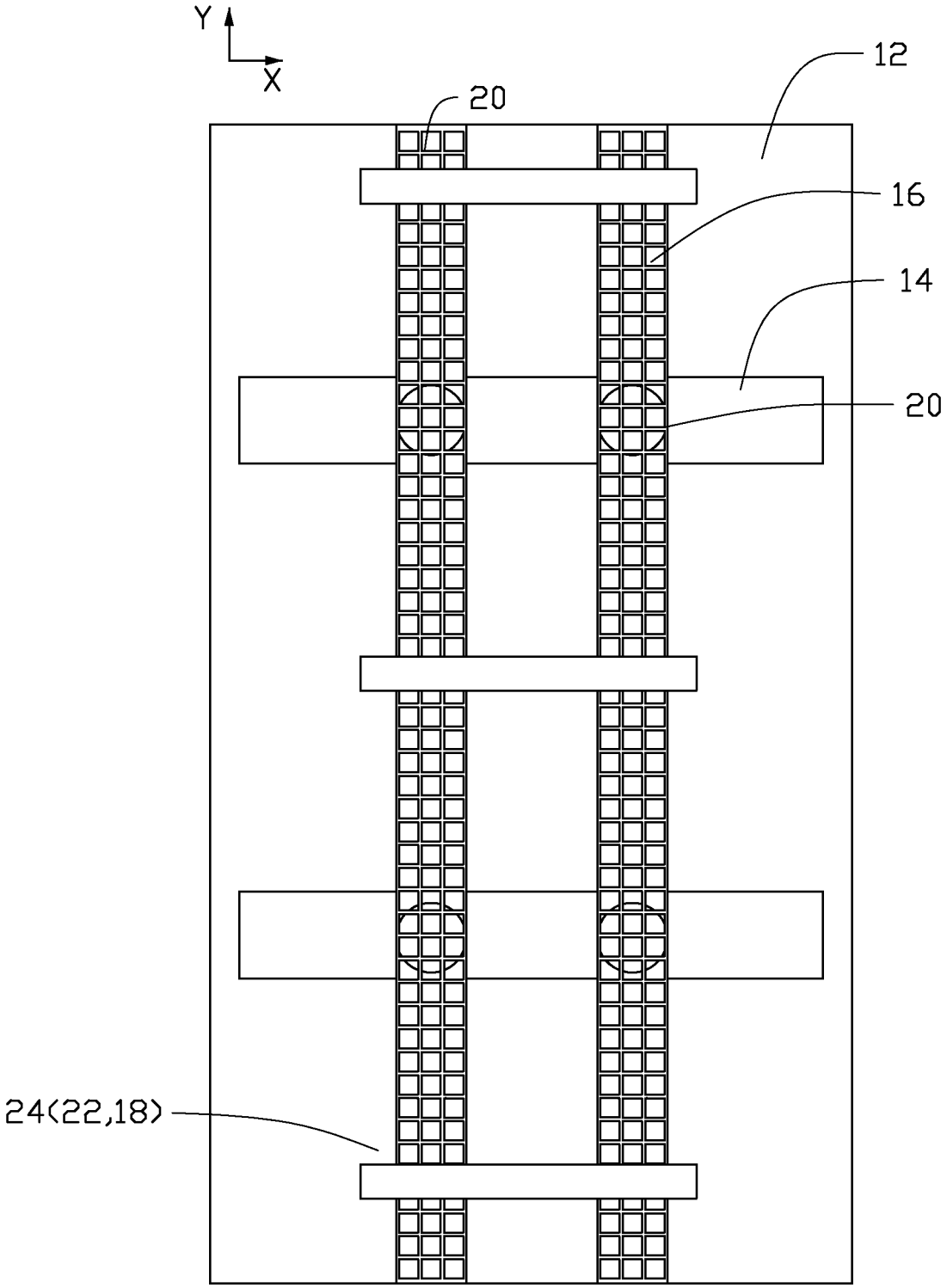
FIG. 4 is a top-view of another embodiment of a field emission cathode structure.

Referring to FIG. 4, a field emission cathode structure of one embodiment is provided. The difference between the field emission cathode structure in FIG. 4 and the field emission cathode structure 10 in FIG. 3 is that along the X direction, only one insulator 18 is located between the two adjacent cathode electrodes 14, and supports the plurality of gate electrodes 20 in the field emission cathode structure in FIG. 4. The fixing layers 22 can be located on the entire top surfaces of the insulators 18 or just cover the top surfaces of the insulators 18 corresponding to the gate electrodes 20.

Figure 5:
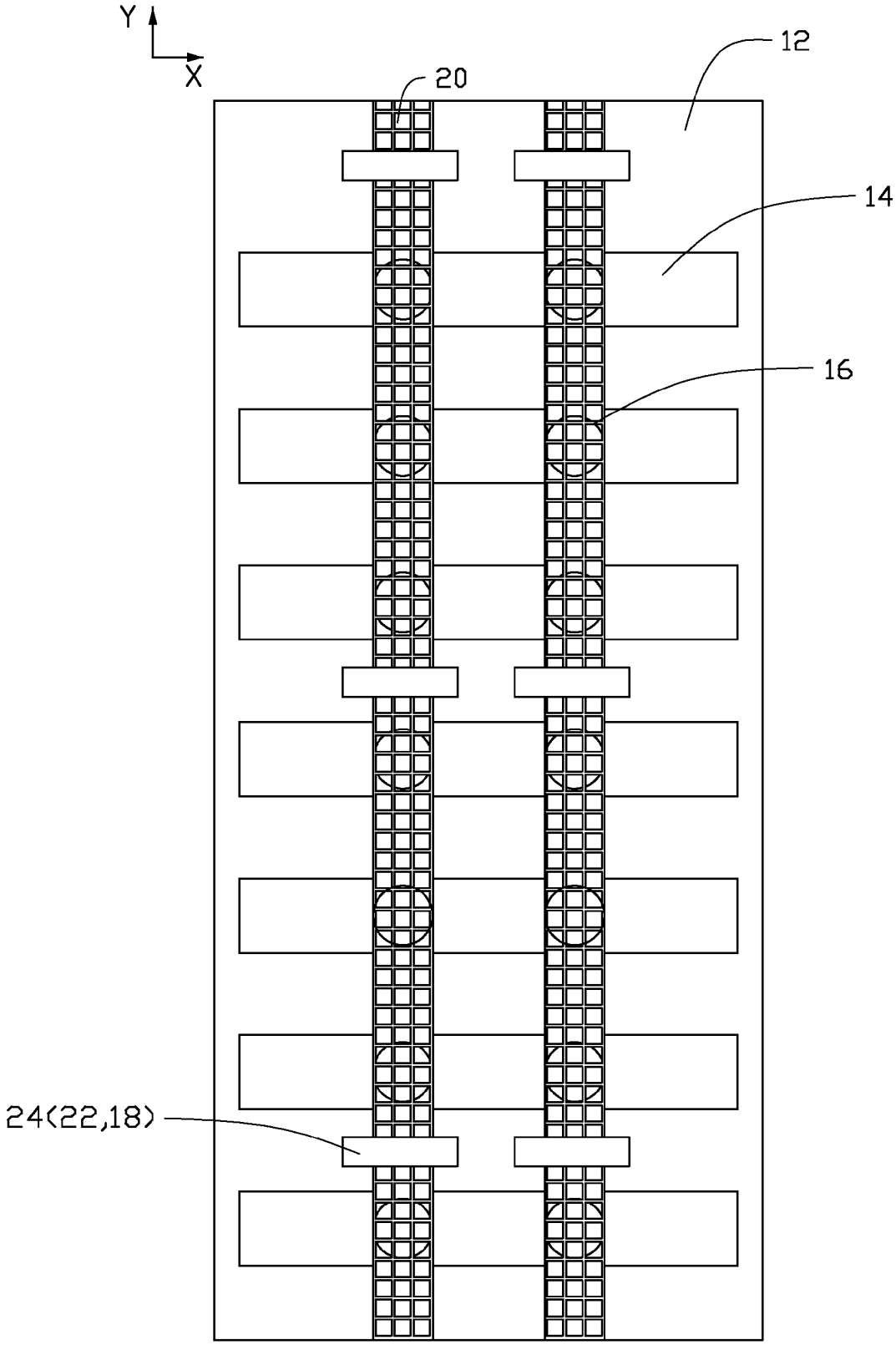
FIG. 5 is a top-view of yet another embodiment of a field emission cathode structure.

Referring to FIG. 5, a field emission cathode structure of one embodiment is provided. The difference between the field emission cathode structure in FIG. 5 and the field emission cathode structure 10 in FIG. 3 is that along the Y direction, more than one cathode electrode 14 is located between two adjacent insulators 18. The less the number of the insulators 18, the less the area of the top surfaces of the fixing layers 22, and the harder the fixing layers 22 accumulate positive charges. In one embodiment, there are three field emission units 16 located between two adjacent insulators 18 along the Y direction.

Figure 6:
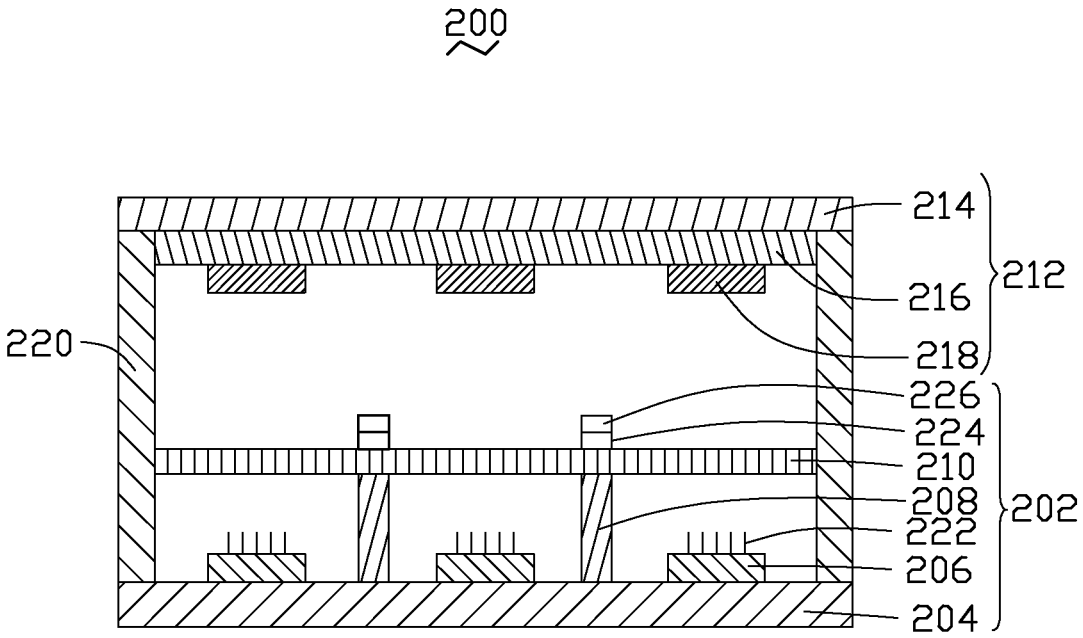
FIG. 6 is a cross-sectional view of one embodiment of a field emission display.

Referring to FIG. 6, a field emission display 200 using a field emission cathode structure 202 is provided. The field emission display 200 includes an anode structure 212 spaced apart from the field emission cathode structure 202. The field emission cathode structure 202 can be the field emission cathode structure shown in FIG. 1, FIG. 4, or FIG. 5. The field emission cathode structure 202 includes an insulating substrate 204, a number of cathode electrodes 206, a number of field emission units 222, a number of insulators 208, a number of gate electrodes 210, a number of fixing layers 224, and a number of conductive layers 226. The anode structure 212 is spaced apart from the gate electrodes 210 of the field emission cathode structure 202.

The anode structure 212 includes a glass substrate 214, a transparent anode 216, and a number of phosphor layers 218. The transparent anode 216 is mounted on the glass substrate 214. The transparent anode 216 can be ITO film. The phosphor layers 218 are coated on the transparent anode 216 and oriented to the locations of the field emission units 222. An insulated spacer 220 is located between the anode structure 212 and the insulating substrate 12 to maintain a vacuum. The edges of the gate electrodes 210 are fixed to the spacer 220.

Figure 7:
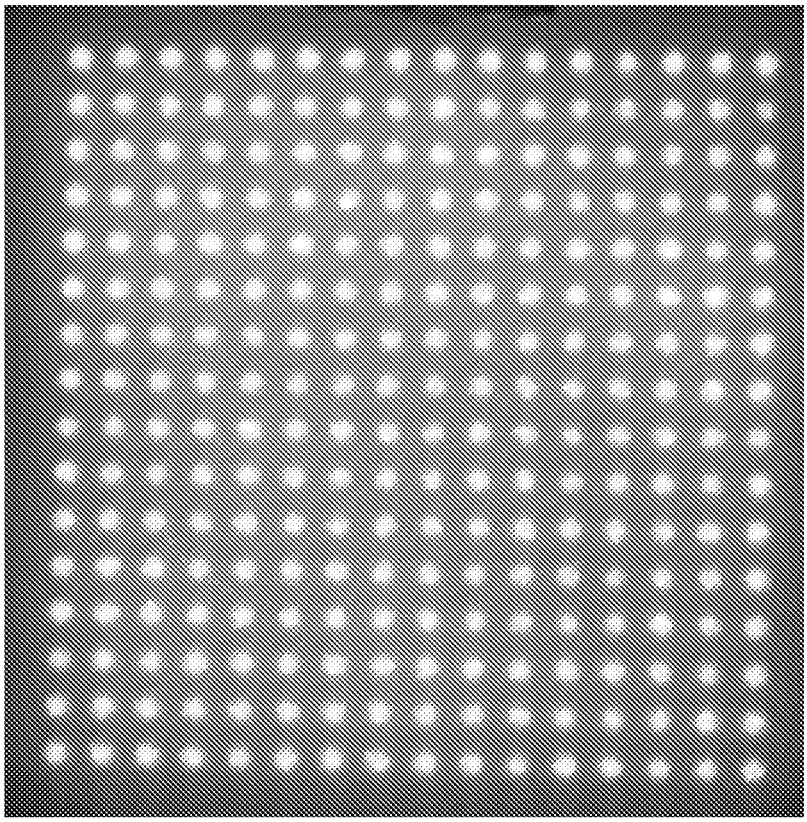
FIG. 7 is a display effect image of one embodiment of a field emission display.

In operation, different voltages are applied to the cathodes electrodes 206, the gate electrodes 210, and the anode 216. In many cases, the voltage of the cathodes 14 is zero or the cathodes 14 are connected to ground. The voltage of the gate electrodes 210 is ten volts to several hundred volts. The electrons emitted by field emission units 222 move towards the gate electrodes 210 under the influence of the applied electric field, and then pass through the meshes of the gate electrodes 210. Finally, the electrons reach the anode 216 under the electric field induced by the anode 216 and collide with the phosphor layers 218 located on the transparent anode 216. The phosphor layers 218 then emits visible light to accomplish the display function of the field emission display 200. The cathode electrodes 206 are insulated from each other, as are the gate electrodes 210. Thus, field emission currents at different field emission units 222 can be easily modulated by selectively changing the voltages of the gate electrodes 210 and the cathode electrodes 206. Referring to FIG. 7, the image of the field emission display 200 is clear, and the resolution of the field emission display 200 is improved.

It is to be understood that the above-described embodiment is intended to illustrate rather than limit the disclosure. Variations may be made to the embodiment without departing from the spirit of the disclosure as claimed. The above-described embodiments are intended to illustrate the scope of the disclosure and not restricted to the scope of the disclosure.

What is claimed is:

1. A field emission cathode structure comprising:

an insulating substrate;

a plurality of strip cathode electrodes located on the insulating substrate, the plurality of strip cathode electrodes being spaced apart from and substantially parallel to each other;

a plurality of insulators located on the insulating substrate;

a plurality of strip gate electrodes substantially perpendicular to the plurality of strip cathode electrodes, the plurality of strip gate electrodes being spaced apart from each other, supported by the plurality of insulators, and spaced apart from the plurality of strip cathode electrodes by the plurality of insulators;

a plurality of electron emission units located at intersections of the plurality of strip cathode electrodes and the plurality of strip gate electrodes, the plurality of electron emission units being electrically connected to the plurality of strip cathode electrodes; and a plurality of fixing layers located on surfaces of the plurality of strip gate electrodes, the plurality of strip gate electrodes being sandwiched by the plurality of fixing layers and the plurality of insulators;

wherein the condition $D1 \leqq D2/10$ is satisfied, wherein D1 is a width of each of the insulators and D2 is a distance between centerlines of each two adjacent field emission units.

2. The field emission cathode structure of claim 1, wherein each of the insulators has a cuboid configuration, each of the fixing layers has a substantially same width and length as that of the insulators.

3. The field emission cathode structure of claim 1, wherein the distance between centerlines of each two adjacent field emission units is less than or equal to 5 millimeters.

4. The field emission cathode structure of claim 3, wherein the distance between centerlines of each two adjacent field emission units is in a range from about 3 millimeters to about 5 millimeters.

5. The field emission cathode structure of claim 1, wherein the width of each of the insulators is in a range from about 100 micrometers to about 500 micrometers.

6. The field emission cathode structure of claim 5, wherein the width of each of the insulators is in a range from about 200 micrometers to about 400 micrometers.

7. The field emission cathode structure of claim 1, wherein the condition $0.125 \leqq D3/D2 \leqq 0.48$ is satisfied, wherein D3 is an effective diameter of each of the plurality of field emission units.

8. The field emission cathode structure of claim 7, wherein the effective diameter of each of the plurality of field emission units is less than 2400 micrometers.

9. The field emission cathode structure of claim 8, wherein the effective diameter of each of the plurality of field emission units is in a range from about 500 micrometers to about 1300 micrometers.

10. The field emission cathode structure of claim 7, wherein a distance between one of the plurality of insulators and one of the plurality of field emission units adjacent to the one of the plurality of insulator is greater than 150 micrometers.

11. The field emission cathode structure of claim 1, wherein the condition 5 micrometers$\leqq$H$\leqq$100 micrometers is satisifed, wherein H is a height of each of the insulators.

12. The field emission cathode structure of claim 11, wherein the height of each of the insulators is in a range from about 10 micrometers to about 15 micrometers.

13. The field emission cathode structure of claim 1, wherein distances between one of the plurality of the insulators and two of the plurality of the strip cathode electrodes adjacent to the one of the plurality of the insulators are equal along a direction substantially parallel to the plurality of strip gate electrodes.

14. The field emission cathode structure of claim 1, wherein only one insulator of the plurality of insulators is located between each two adjacent cathode electrodes along a direction substantially parallel to the plurality of strip cathode electrodes.

15. The field emission cathode structure of claim 1, wherein more than one insulator is located between each two adjacent cathode electrodes along a direction substantially parallel to the plurality of strip cathode electrodes, and each of the plurality of insulators supports a single gate electrode.

16. The field emission cathode structure of claim 1, wherein more than one cathode electrode is located between two adjacent insulators along a direction substantially parallel to the plurality of strip gate electrodes.

17. The field emission cathode structure of claim 1, wherein a thickness of each of the plurality of fixing layers is less than 10 micrometers.

18. The field emission cathode structure of claim 1, further comprising a plurality of conductive layers located on surfaces of the plurality of fixing layers far away from the plurality of strip gate electrodes.

19. A field emission cathode structure comprising:

an insulating substrate;

a plurality of strip cathode electrodes located on the insulating substrate, the plurality of strip cathode electrodes being spaced apart from and substantially parallel to each other;

a plurality of insulators located on the insulating substrate;

a plurality of strip gate electrodes substantially perpendicular to the plurality of strip cathode electrodes, the plurality of strip gate electrodes being spaced apart from each other, supported by the plurality of insulators, and spaced apart from the plurality of strip cathode electrodes by the plurality of insulators;

a plurality of electron emission units located at intersections of the plurality of strip cathode electrodes and the plurality of strip gate electrodes, the plurality of electron emission units being electrically connected to the plurality of strip cathode electrodes; and a plurality of fixing layers located on surfaces of the plurality of strip gate electrodes, wherein the plurality of strip gate electrodes is sandwiched by the plurality of fixing layers and the plurality of insulators;

wherein: the conditions $D1 \leqq D2/10$, $0.125 \leqq D3/D2 \leqq 0.48$, 5 micrometers$\leqq$H$\leqq$100 micrometers are satisfied, wherein D1 is a width of each of the plurality of insulators, H is a height of each of the plurality of insulators, D2 is a distance between centerlines of each two adjacent field emission units, and D3 is an effective diameter of each of the plurality of field emission units.

20. A field emission display, comprising a field emission cathode structure and an anode structure spaced apart from the field emission cathode structure, the field emission cathode structure comprising:

an insulating substrate;

a plurality of strip cathode electrodes located on the insulating substrate, the plurality of strip cathode electrodes being spaced apart from and substantially parallel to each other;

a plurality of insulators located on the insulating substrate;

a plurality of strip gate electrodes substantially perpendicular to the plurality of strip cathode electrodes, the plurality of strip gate electrodes being spaced apart from each other, supported by the plurality of insulators, and spaced apart from the plurality of strip cathode electrodes by the plurality of insulators;

a plurality of electron emission units located at intersections of the plurality of strip cathode electrodes and the plurality of strip gate electrodes, the plurality of electron emission units being electrically connected to the plurality of strip cathode electrodes; and a plurality of fixing layers located on surfaces of the plurality of strip gate electrodes, the plurality of strip gate electrodes being sandwiched by the plurality of fixing layers and the plurality of insulators;

wherein the condition $D1 \leqq D2/10$ is satisfied, wherein D1 is a width of each of the insulators and D2 is a distance between centerlines of each two adjacent field emission units.

* * * * *